US009745654B2

(12) United States Patent
Oh et al.

(10) Patent No.: US 9,745,654 B2
(45) Date of Patent: Aug. 29, 2017

(54) HOT DIP ZINC ALLOY PLATED STEEL SHEET HAVING EXCELLENT CORROSION RESISTANCE AND EXTERNAL SURFACE AND METHOD FOR MANUFACTURING SAME

(71) Applicant: POSCO, Pohang-si (KR)

(72) Inventors: Min-Suk Oh, Gwangyang-si (KR); Young-Sool Jin, Gwangyang-si (KR); Sang-Heon Kim, Gwangyang-si (KR); Su-Young Kim, Gwangyang-si (KR); Bong-Hwan Yoo, Gwangyang-si (KR)

(73) Assignee: POSCO, Pohang-si (KR)

( * ) Notice: Subject to any disclaimer, the term of this patent is extended or adjusted under 35 U.S.C. 154(b) by 22 days.

(21) Appl. No.: 14/413,530

(22) PCT Filed: Jul. 23, 2013

(86) PCT No.: PCT/KR2013/006589
§ 371 (c)(1),
(2) Date: Jan. 8, 2015

(87) PCT Pub. No.: WO2014/017805
PCT Pub. Date: Jan. 30, 2014

(65) Prior Publication Data

US 2015/0159253 A1 Jun. 11, 2015

(30) Foreign Application Priority Data

Jul. 23, 2012 (KR) ..... 10-2012-0080021

(51) Int. Cl.
*B32B 15/01* (2006.01)
*C23C 2/06* (2006.01)
(Continued)

(52) U.S. Cl.
CPC ..... *C23C 2/06* (2013.01); *C22C 18/00* (2013.01); *C22C 18/04* (2013.01); *C23C 2/16* (2013.01);
(Continued)

(58) Field of Classification Search
None
See application file for complete search history.

(56) References Cited

U.S. PATENT DOCUMENTS 3,505,043 A 4/1970 Lee et al.
6,235,410 B1 5/2001 Komatsu et al.
(Continued)

FOREIGN PATENT DOCUMENTS

CN 1211286 A 3/1999
CN 1342211 A 3/2002
(Continued)

*Primary Examiner* — Daniel J Schleis
(74) *Attorney, Agent, or Firm* — The Webb Law Firm

(57) ABSTRACT

Provided is a hot dip zinc alloy plated steel sheet which is widely used in vehicles, domestic appliances, construction materials or the like and a method for manufacturing the same. A Zn—Al—Mg hot dip zinc alloy plating bath is used for manufacturing the hot dip zinc alloy plated steel strip, and a small amount of Ga or In is added to the plating bath for inhibiting an oxidation reaction of Mg in the plating bath so as to obtain excellent corrosion resistance and external surface of the plated steel sheet which is manufactured at this point.

7 Claims, 3 Drawing Sheets

(51) Int. Cl.

| | |
|---|---|
| ***C23C 2/20*** | (2006.01) |
| ***C22C 18/04*** | (2006.01) |
| ***C22C 18/00*** | (2006.01) |
| ***C23C 2/16*** | (2006.01) |
| ***C23C 2/28*** | (2006.01) |

(52) U.S. Cl.
CPC ..... *C23C 2/20* (2013.01); *C23C 2/28* (2013.01); *Y10T 428/12799* (2015.01)

(56) References Cited

U.S. PATENT DOCUMENTS

| | | | | |
|---|---|---|---|---|
| 6,465,114 | B1 | 10/2002 | Honda et al. | |
| 7,534,502 | B2 * | 5/2009 | Honda ..... | B32B 15/013 428/659 |

FOREIGN PATENT DOCUMENTS

| | | | |
|---|---|---|---|
| JP | 08-060324 | | 3/1996 |
| JP | 10-226865 | | 8/1998 |
| JP | 11-140615 | | 5/1999 |
| JP | 2000-104154 | | 4/2000 |
| JP | 2002146502 | A | 5/2002 |
| JP | 2002-206156 | | 7/2002 |
| JP | 2002-285311 | | 10/2002 |
| JP | 2002285311 | * | 10/2002 |
| JP | 2003-138359 | | 5/2003 |
| JP | 2003-328101 | A | 11/2003 |
| JP | 2004-019000 | A | 1/2004 |
| JP | 2005-336546 | A | 12/2005 |
| KR | 10-2002-0019446 | A | 3/2002 |
| KR | 10-2002-0041029 | A | 6/2002 |
| KR | 10-2005-0068257 | A | 7/2005 |
| RU | 2010144157 | A | 5/2012 |
| RU | 2470088 | C2 | 12/2012 |
| WO | 2006/002843 | | 1/2006 |

* cited by examiner

[COOLING RATE OF 10℃/S OR GREATER]

[COOLING RATE OF LESS THAN 10℃/S]

HOT DIP ZINC ALLOY PLATED STEEL SHEET HAVING EXCELLENT CORROSION RESISTANCE AND EXTERNAL SURFACE AND METHOD FOR MANUFACTURING SAME

CROSS-REFERENCE TO RELATED APPLICATIONS

This application is the United States national phase of International Application No. PCT/KR2013/006589 filed Jul. 23, 2013, and claims priority to Korean Patent Application No. 10-2012-0080021 filed Jul. 23, 2012, the disclosures of which are hereby incorporated in their entirety by reference.

TECHNICAL FIELD

The present disclosure relates to a hot-dip zinc alloy plated steel sheet widely used in automobiles, home appliances, building materials, and the like, and a method for manufacturing the same.

BACKGROUND ART

A zinc plating method suppressing the corrosion of iron through cathodic way has excellent anti-corrosion efficiency and economic feasibility, and has thereby been widely used in preparing steel materials having good anti-corrosion properties. Particularly, a hot-dip zinc plated steel sheet of which plating layer is formed by immersing a steel material in molten zinc has a simpler manufacturing process and lower product prices compared to electro zinc plated steel sheets, and consequently, demand therefor has increased in a wide range of industries, such as an automotive industry, an electrical appliance industry and a construction industry.

A zinc plated hot-dip zinc plated steel sheet has a sacrificial corrosion protection properties in which corrosion of a steel plate is suppressed by zinc, having a lower oxidation-reduction potential than iron, iron being corroded more quickly than zinc when exposed to a corrosive environment, and in addition thereto, improves corrosion resistance of the steel plate by forming compact corrosion products on the surface of the steel plate as the zinc of the plating layer is oxidized, thereby blocking the steel material from an oxidizing environment.

However, air pollution and the worsening of other environmental pollution has been increasing, due to the proliferation of industrial activity, and regulations on resource and energy savings have been tightened, and consequently, the need to develop a steel material having improved excellent corrosion resistance as compared to existing zinc plated steel sheets has increased.

In this regard, research into manufacturing a zinc alloy-based plated steel sheet for improving corrosion resistance of a steel material by adding elements such as aluminum (Al) and magnesium (Mg) to a zinc plating bath have been conducted.

Typical zinc alloy-based plating materials include a [Zn-55 wt % Al-1.6 wt % Si] plated steel sheet, however, in this case, a sacrificial corrosion protection ability of the plating layer may be problematically reduced due to a high Al content, and therefore, corrosion is preferentially caused in regions of a parent material directly exposed to a corrosive environment, such as a cut surface and a bending portion.

In addition, in the case that an Al content in a plating bath is high at a level of 50 wt % or greater, the temperature of the plating bath needs to be maintained at 600° C. or higher, therefore, the generation of Fe alloy-based dross in the plating bath becomes a serious issue, due to the corrosion of the parent material steel plate, and as a result, there is a disadvantage in that plating workability is reduced, and the lifespan of facilities may be shortened, since corrosion of the facilities inside the plating bath, such as a that in a sink roll may be accelerated.

In view of the above, research into Zn—Al—Mg alloy plating material containing Mg in a Zn—Al-based plating bath have been actively undertaken in order to enhance corrosion resistance of a cut surface region and a processed portion while reducing an Al content in the plating bath.

For example, Patent Document 1 discloses a method for manufacturing a hot-melt zinc alloy-based plated steel sheet prepared using a plating bath containing 3 to 17 wt % of Al and 1 to 5 wt % of Mg, while Patent Documents 2 to 4 disclose a plating technology improving corrosion resistance and manufacturing properties by mixing various addition elements in a plating bath having the same composition as above, or by controlling manufacturing conditions.

However, Mg is lighter than Zn, a main element in a plating composition, and has high oxidation limit, therefore, a large quantity of Mg may float on the top of a plating bath during a hot-melt process, and the floating Mg may lead to an oxidation reaction after being exposed to air on the plating bath surface, resulting in the generation of a large quantity of dross. This phenomenon may lead to dross defects through dross being attached to a steel material immersed in the plating bath during a plating process, thus compromising the plating layer surface formed on the steel material or precluding plating work.

Accordingly, the generation of dross due to Mg oxidation needs to be suppressed, and technologies regarding this have currently been proposed.

For example, Patent Document 5 discloses a method of preventing the oxidation of plating bath components and improving workability by adding one or more types of Ca, Be and Li in an amount of 0.001 to 0.01 wt % when preparing a Zn—Al—Mg alloy-based plated steel sheet including 0.06 to 0.25 wt % of Al and 0.2 to 3.0 wt % of Mg. However, in this technology, the amount of the addition elements added is extremely small and verification of the efficiency of the addition elements is difficult, and this technology only applies to alloy compositions in which a large quantity of Mg oxidizable dross is formed inside a plating bath, since Al content is very low, on the level of 0.25 wt % or below.

As another technology, Patent Document 6 discloses a method suppressing the generation of dross by adding 0.01 to 1.0 wt % of Ti and 0.01 to 2.0 wt % of Na when preparing a Zn—Al—Mg alloy-based plated steel sheet including 1 to 4 wt % of Al and 2 to 20 wt % of Mg. However, the melting point of Ti is 1668° C., excessively high compared to the temperature of a plating bath, and the specific gravity of Na is 0.96 g/cm$^3$, excessively low compared to 7.13 g/cm$^3$, the specific gravity of Zn, and in practice, adding these elements to a plating bath is relatively complex.

Meanwhile, in addition to an object of preventing Mg oxidation in a plating bath, trace elements are sometimes added in order to improve corrosion resistance of a plating material.

For example, Patent Document 7 discloses a method of enhancing corrosion resistance of a formed plating layer by additionally adding one or more of 0.01 to 1.0 wt % of In, 0.01 to 1.0 wt % of Bi and 1 to 10 wt % of Sn to a plating bath including 2 to 19 wt % of Al, 1 to 10 wt % of Mg and 0.01 to 2.0 wt % of Si. However, as a result of extensive research, the inventors of the present disclosure have identified that, in the case that Si is added to a plating bath containing Al and Mg, significantly more dross is generated on the top of the plating bath as compared to a plating bath in which Si is not added, and as a result, surface defects may be induced in the plating layer. In addition, it has been identified that a $Mg_2Si$ phase and a Zn—Al—Mg—Si quaternary interfacial alloy phase that are necessarily formed inside a plating layer due to the addition of Si increase the hardness of the plating layer, and increase the width of cracks in a processed portion, which is formed in the process, leading to the worsening of corrosion resistance in the processed portion.

Accordingly, in adding Al and Mg to a plating bath for improving corrosion resistance of a plating steel material, methods capable of solving such problems described above need to be explored.

(Patent Document 1) U.S. Pat. No. 3,505,043

(Patent Document 2) Japanese Patent Laid-Open Publication No. 2000-104154

(Patent Document 3) Japanese Patent Laid-Open Publication No. 1999-140615

(Patent Document 4) International Patent Publication No. WO06/002843

(Patent Document 5) Japanese Patent Laid-Open Publication No. 1996-060324

(Patent Document 6) Korean Patent Laid-Open Publication No. 2002-0041029

(Patent Document 7) Korean Patent Laid-Open Publication No. 2002-0019446

SUMMARY OF THE INVENTION

An aspect of the present disclosure may provide a hot-dip zinc alloy plated steel sheet having excellent corrosion resistance and an excellent external surface, prepared using a Zn—Al—Mg-based hot-dip zinc alloy plating bath, and a method for manufacturing the same.

Technical Solution

According to an aspect of the present disclosure, a hot-dip zinc alloy plated steel sheet having excellent corrosion resistance and an excellent external surface includes a base steel plate and a hot-dip zinc alloy plating layer, wherein a composition of the hot-dip zinc alloy plating layer includes, in % by weight, aluminum (Al): 0.5 to 5.0% and magnesium (Mg): 1 to 5%, one or two types of gallium (Ga): 0.01 to 0.1% and indium (In): 0.005 to 0.1%, and a remainder of zinc (Zn) and unavoidable impurities, and a compositional ratio of the Mg and the Al satisfies a relationship of [Al+Mg≤7].

According to another aspect of the present disclosure, a method for manufacturing a hot-dip zinc alloy plated steel sheet having excellent corrosion resistance and an excellent external surface includes preparing a hot-dip zinc alloy plating bath including, in % by weight, aluminum (Al): 0.5 to 5.0% and magnesium (Mg): 1 to 5%, one or two types of gallium (Ga): 0.01 to 0.1% and indium (In): 0.005 to 0.1%, and a remainder of zinc (Zn) and unavoidable impurities, and a compositional ratio of the Mg and the Al satisfies a relationship of [Al+Mg≤7]; preparing a plated steel sheet by immersing a base steel plate in the hot-dip zinc alloy plating bath and carrying out plating; and gas wiping and cooling the plated steel sheet.

As set forth above, according to exemplary embodiments of the present disclosure, a small amount of elements preventing the oxidation of Mg is added in order to effectively suppress the generation of dross formed on the top of a plating bath caused by an oxidation reaction of Mg that is added for the enhancement of corrosion resistance of a zinc plating layer, and as a result, plating workability is improved, and at the same time, the surface defects of the plating layer are reduced, and therefore, a hot-dip zinc alloy plated steel sheet having elegant external surface can be provided. This is suitable for use in the field of construction materials, home appliances and the like.

DESCRIPTION OF THE DRAWINGS

The above and other aspects, features and other advantages of the present disclosure will be more clearly understood from the following detailed description taken in conjunction with the accompanying drawings, in which.

DESCRIPTION AND BEST MODE OF THE INVENTION

Figure 1:
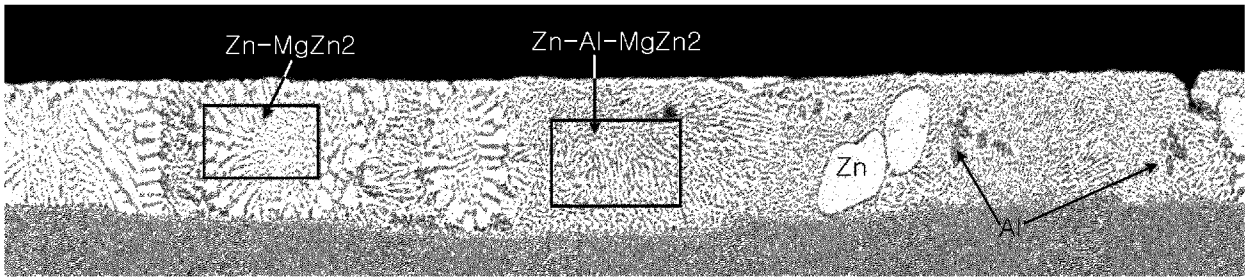
FIG. 1 illustrates a plated structure in a plating layer of a hot-dip zinc alloy plated steel sheet according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

First, a hot-dip zinc alloy plating bath used in the present disclosure will be described in detail.

The hot-dip zinc alloy plating bath used in the present disclosure preferably includes, in % by weight, aluminum (Al): 0.5 to 5.0% and magnesium (Mg): 1 to 5%, one or two types of gallium (Ga): 0.01 to 0.1% and indium (In): 0.005 to 0.1%, and a remainder of zinc (Zn) and unavoidable impurities, and the compositional ratio of the Mg and the Al satisfies a relationship of [Al+Mg≤7].

Among the components in the hot-dip zinc alloy plating bath, Mg is an element playing a very important role in enhancing the corrosion resistance of a plating layer, and the Mg included in the plating layer suppresses the growth of zinc oxide-based corrosion products having a low corrosion property enhancing effect in harsh corrosive environments, and stabilizes zinc hydroxide-based corrosion products that are compact and having a high corrosion resistance enhancing effect on the plating layer.

However, in the case that the content of such an Mg component is less than 1% by weight, a corrosion resistance enhancing effect by the production of Zn—Mg-based compounds is not sufficient, and in the case that the content is greater than 5% by weight, a corrosion resistance enhancing effect is saturated and a problem of Mg oxidizable dross sharply increasing on the bath surface of a plating bath occurs. Accordingly, in the present disclosure, controlling the Mg content in the plating bath to 1 to 5% by weight is preferable.

The Al is added for the purpose of reducing dross generated due to an Mg oxidation reaction in an Mg-added hot-dip zinc alloy plating bath, and by being combined with Zn and Mg, the Al also plays a role in enhancing the corrosion resistance of a plated steel sheet.

In the case that the content of the Al is less than 0.5% by weight, an effect of preventing the oxidation of a plating bath surface layer by the addition of Mg is insufficient, and a corrosion resistance enhancing effect may be relatively low. However, in the case that the Al content is greater than 5.0% by weight, an Fe yield of a steel plate immersed in the plating bath rapidly increases, resulting in the formation of Fe alloy-based dross, and moreover, a problem of a reduction in the weldability of the plating layer occurs. Accordingly, in the present disclosure, controlling the Al content in the plating bath to 0.5 to 5.0% by weight is preferable.

In the hot-dip zinc alloy plating bath used in the present disclosure, one or two types of Ga or In are added in addition to the Mg and the Al, in order to prevent Mg oxidation on the bath surface of the plating bath, thereby reducing the generation of dross on the top of the bath surface. The Ga or In reduces an Fe yield of a steel plate immersed in the plating bath which thereby reduces the generation of Fe alloy-based dross, and therefore, also plays a role of enhancing anti-corrosion properties of the plated steel sheet.

In order to obtain the effects described above, Ga is preferably included in an amount of 0.01 to 0.1% by weight, and In is preferably included in an amount of 0.005 to 0.1% by weight. In adding these elements, in the case that respective contents thereof are increased to be greater than 0.1% by weight, grain boundary segregation is induced lowering the corrosion resistance of the plating layer, and therefore, respective contents are limited to 0.1% by weight or less.

When Mg is added to the plating bath in the art for enhancing corrosion resistance, Al is added in a large amount in order to suppress oxidation by Mg; however, in the present disclosure, by adding a small amount of Ga or In that is more effective in preventing Mg oxidation, plating bath dross resulting from Mg oxidation may be reduced while the Al content of the plating layer is not maintained at a high level, and may suppress an Fe yield of the steel plate at the same time. In addition, these elements do not change other physical properties other than enhancing the corrosion resistance of the plating layer, and do not significantly change common applications of the plating bath.

In addition to this, by limiting the addition of Si which may be additionally added to the plating bath, the formation of dross on the top of the plating bath is suppressed, and improvements in plating workability may result.

Al and Mg are elements enhancing the corrosion resistance of the plating layer, and corrosion resistance may be enhanced as the sum of these elements increases. However, in the case that the sum of the % by weight of the Al and the Mg in the plating bath is greater than 7.0%, there may be problems in that plating layer hardness may be increased, facilitating the occurrences of process cracks, weldability and coatability may be degraded, or improvements in the treatment method may be required, while a corrosion resistance enhancement effect is saturated.

Hereinafter, a hot-dip zinc alloy plated steel sheet according to the present disclosure will be described in detail.

The hot-dip zinc alloy plated steel sheet of the present disclosure preferably includes a base steel plate and a hot-dip zinc alloy plating layer, and the composition of the hot-dip zinc alloy plating layer includes, in % by weight, Al: 0.5 to 5.0% and Mg: 1 to 5%, one or two types of Ga: 0.01 to 0.1% and In: 0.005 to 0.1%, and a remainder of Zn and unavoidable impurities, and the compositional ratio of the Mg and the Al satisfies a relationship of [Al+Mg≤7].

In the hot-dip zinc alloy plated steel sheet according to the present disclosure, the hot-dip zinc alloy plating layer formed with the composition described above is preferably attached in a plating amount of 10 to 500 g/m$^2$ based on one surface. In the case that the plating amount is less than 10 g/m$^2$ based on one surface, anti-corrosion properties are difficult to expect, and having a plating amount of one surface greater than 500 g/m$^2$ is economically unfavorable.

Accordingly, plating in the plating amount range of 10 to 500 g/m$^2$ is preferable in order to accomplish alloy plating having high anti-corrosion properties.

In addition, as shown in FIG. 1, the plated structure of the hot-dip zinc alloy plating layer employs a Zn—Al—$MgZn_2$ ternary eutectic structure as a base structure, and includes a plated structure in which a Zn—$MgZn_2$ binary eutectic structure is dispersed, includes a crystal structure in which Al and Zn single phase structures are uniformly distributed, and includes a $MgZn_2$ structure as a remainder thereof.

Figure 2:
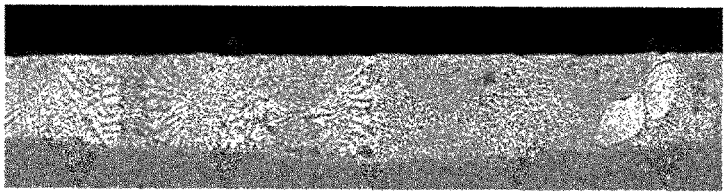
FIG. 2 illustrates plated structures of a plating layer depending on cooling rates.
Figure 2:
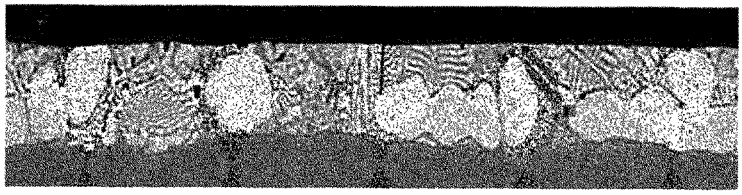

In order to obtain excellent corrosion resistance, an object of the present disclosure, securing a large area of binary and ternary eutectic structures in the plated structure of a plating layer is preferable while reducing the area of Al and Zn single phase structures, and the formation of the single phase structure in the plating layer may be affected by the cooling rate in a cooling step to be subsequently undertaken (please refer to FIG. 2).

Under a corrosive environment, zinc forms corrosion products such as zincite (ZnO), hydrozincite ($Zn_5(CO_3)_2(OH)_6$) and simonkolleite ($Zn_5(OH)_8C_{12}$), and thereamong, simonkolleite has an excellent corrosion suppression effect as a compact corrosion product. In a Zn—Al—Mg-based hot-dip zinc alloy plated steel sheet, the Mg in the plating layer facilitates the production of simonkolleite, thereby enhancing the corrosion resistance of the plating layer, and therefore, the Al and the Zn single phase structures are controlled to be formed in 20% or less in the present disclosure. In the case that the Al and the Zn single phase structures are formed in an amount greater than 20%, the production of simonkolleite is reduced under a corrosive environment causing a problem of a decrease in corrosion resistance.

In a common hot-melt plating process, skin pass rolling is carried out after plating, therefore, an appropriate degree of roughness (Ra) is generally provided on the surface of a steel plate. Surface roughness of a steel plate is an important factor affecting processability improvements in press forming and image clarity after coating, and needs to be managed. For this, skin pass rolling is carried out using a roll having appropriate surface roughness, and as a result, roughness may be provided on the surface of the steel plate by transferring the roughness of the roll to the steel plate.

In the case that the surface of the plating layer formed after plating is roughened, there is a problem in that surface roughness may be non-uniformly formed after carrying out skin pass rolling, since the roughness of the roll is difficult to uniformly transfer to the steel plate in skin pass rolling. In other words, in the case that the surface of a plating layer has a low degree of roughness, the roughness of the roll may be readily and uniformly transferred to the steel plate in skin pass rolling, and therefore, lowering the roughness of the plating layer by as much as possible is preferable before skin pass rolling. Accordingly, in the present disclosure the surface roughness (Ra) of the hot-dip zinc alloy plated steel sheet is preferably managed to be 1 μm or less.

Hereinafter, a method for manufacturing a hot-dip zinc alloy plated steel sheet according to the present disclosure will be described in detail.

The method for manufacturing a hot-dip zinc alloy plated steel sheet of the present disclosure includes preparing the hot-dip zinc alloy plating bath described above; preparing a plated steel sheet by immersing a base steel plate in the hot-dip zinc alloy plating bath and carrying out plating; and gas wiping the plated steel sheet.

In the case that the plating is carried out by dipping the base steel plate in the hot-dip zinc alloy plating bath, common plating bath temperatures used in hot-dip zinc alloy plating may be used, and plating may be preferably carried out in a plating bath having a temperature within a range of 380 to 450° C.

Generally, in the case that the content of Al, among the components in a plating bath, increases, the melting point increases and the temperature of the plating bath needs to be raised. However, in the case that the temperature of the plating bath increases, the parent steel plate and internal facilities in the plating bath are eroded leading to a shortening of the lifespan thereof, and there is also a problem in that the surface of the plating materials in the plating bath may be problematic, due to the increase of Fe alloy dross formed thereon.

In the present disclosure, the Al content is controlled to be relatively low, at 0.5 to 5.0% by weight, therefore, the temperature of the plating bath does not have to be high, and common plating bath temperatures are preferably used.

After completing the plating, the coating weight of the plating may be adjusted by gas wiping the steel plate having the plating layer formed thereon. The gas wiping is for adjusting the coating weight of the plating, and the method is not particularly limited.

Herein, air or nitrogen may be provided as the gas, and here nitrogen may be more preferable. This is due to the fact that, in the case that air is used, Mg oxidation preferentially occurs on the plating layer surface inducing surface defects in the plating layer.

After adjusting the coating weight of the plating layer by a gas wiping process, cooling may be carried out.

When cooling, rapid cooling at a cooling rate of 10° C./s or greater is preferable, and the cooling is preferably carried out immediately after gas wiping to a point in time at which coagulation ends.

The plated structure of the plating layer changes depending on a cooling rate, and in the case that a cooling rate is less than 10° C./s, a Zn single phase increases, and the increased Zn single phase has a negative influence on the corrosion resistance of the steel plate. When referring to FIG. 2, it can be seen that, in the case that a cooling rate is less than 10° C./s, the formation of the Zn single phase increases in a plated structure compared to in the case that a cooling rate is 10° C./s or greater.

As the cooling method that is used for cooling at the cooling rate described above, common cooling methods capable of cooling a plating layer may be used, and for example, cooling may be carried out using an air jet cooler, $N_2$ wiping, spraying a water mist, or the like.

Hereinafter, the present disclosure will be described in more detail with reference to examples. However, the following examples are for illustrative purposes only, and should not be seen as limiting the scope of the present disclosure. The scope of the present disclosure should be determined by the claims and information reasonably inferable therefrom.

MODE FOR INVENTION

Example 1

In order to evaluate an influence of plating bath constituent compositions on dross formation, hot-dip zinc alloy plating baths of 10 Kg having compositions shown in the following Table 1 were prepared using a plating bath simulator.

After completely removing the dross caused by other impurities included in an ingot itself in the dry bath of the plating bath, the plating bath was exposed to an oxidizable atmospheric environment while maintaining the plating bath temperature at 440° C. The plating bath was maintained for 24 hours under the conditions described above, and then dross formed on the bath surface of the plating bath was collected and then the weight of the dross was measured.

Measurement results are shown in the following Table and FIG. 3, and cases in which the weight of the collected dross was 200 g or less were set as Invention Example.

TABLE 1

| | | Plating Bath Composition (% by weight) | | | | | | Dross |
|---|---|---|---|---|---|---|---|---|
| Category | | Al | Mg | Al + Mg | In | Ga | Si | Weight (g) |
| Invention Example | 1-1 | 2.5 | 3 | 5.5 | 0.005 | — | — | 185.3 |
| | 1-2 | 2.5 | 3 | 5.5 | 0.01 | — | — | 115 |
| | 1-3 | 2.5 | 3 | 5.5 | 0.1 | — | — | 64.02 |
| | 1-4 | 2.5 | 3 | 5.5 | — | 0.01 | — | 174 |
| | 1-5 | 2.5 | 3 | 5.5 | — | 0.1 | — | 102.1 |
| | 1-6 | 2.5 | 3 | 5.5 | 0.05 | 0.05 | — | 89.3 |
| | 1-7 | 2.5 | 3.5 | 6 | 0.1 | — | — | 101.5 |
| Comparative Example | 1-1 | — | 3 | 3 | — | — | — | All became dross |
| | 1-2 | 0.5 | 3 | 3.5 | — | — | — | 458.2 |
| | 1-3 | 1 | 3 | 4 | — | — | — | 330.3 |
| | 1-4 | 2 | 3 | 5 | — | — | — | 236.2 |
| | 1-5 | 2.5 | 3 | 5.5 | — | 0.005 | — | 201.3 |
| | 1-6 | 2.5 | 3 | 5.5 | — | — | 0.02 | 291.5 |
| | 1-7 | 2 | 4 | 6 | — | — | — | 324.8 |
| | 1-8 | 2.5 | 3 | 5.5 | — | — | 0.1 | 448.5 |
| | 1-9 | 2 | 5 | 7 | — | — | — | 389 |
| | 1-10 | 2.5 | 5 | 7.5 | 0.1 | — | — | 352.2 |
| | 1-11 | 2.5 | 5 | 7.5 | 0.2 | — | — | 346.6 |
| | 1-12 | 2.5 | 5 | 7.5 | — | 0.1 | — | 365 |
| | 1-13 | 4 | 5 | 9 | — | — | — | 323.6 |

Figure 3:
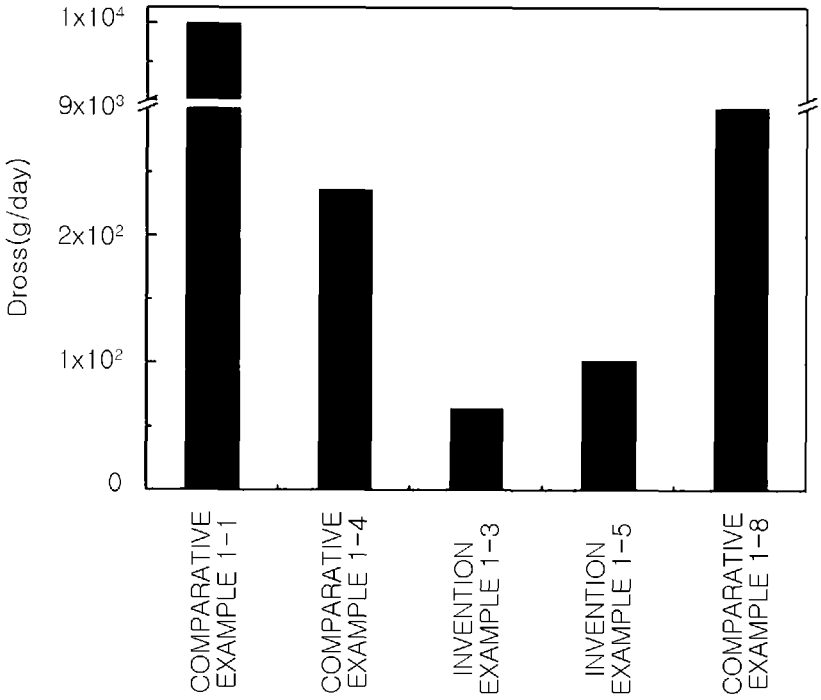
FIG. 3 illustrates results after measuring a weight of dross generated on the bath surface of a plating bath depending on the constituents of a hot-dip zinc alloy plating bath.

As shown in Table 1 and FIG. 3, in the case that only 3% by weight of Mg is included in the zinc plating bath (Comparative Example 1-1), weight measurement was impossible since the whole plating bath became solid dross due to the strong oxidation reaction of Mg, and in Comparative Example 1-4 in which 2% by weight of Al was added thereto, the weight of the dross generated was 236.2 g, therefore, it was seen that dross formation was reduced, as compared to Comparative Example 1. However, there was still a problem in that 200 g or more dross was generated. In addition, when Si was added in the plating bath containing Mg and Al (Comparative Examples 1-6 and 1-8), the generation of dross further increased, and as the added Si amount increased, a large quantity of dross, 400 g or greater, was generated.

Moreover, as shown in Table 1, a large quantity of dross, which was 458.2 g, was generated since the oxidation reaction of Mg was not suppressed in Comparative Example 1-2 in which a small amount (0.5% by weight) of Al was added, and 300 g or more dross was also generated in Comparative Examples 1-3, 1-7, 1-9 and 1-13 in which only Al and Mg were added without further adding In or Ga. In Comparative Examples 1-10 to 1-12, the Al and Mg compositional ratio was not satisfied and 300 g or more dross was generated even when In or Ga was added, and in Comparative Example 1-5, the Al and Mg compositional ratio was satisfied, and the amount of the dross generated greatly decreased due to the addition of Ga, however, the amount of added Ga was not sufficient and 200 g or more dross was still generated.

Meanwhile, as shown in Table 1 and FIG. 3, it was identified that, when In (Invention Example 1-3) or Ga (Invention Example 1-5) were each added in 0.1% by weight, the amount of dross generated significantly decreased to 64.02 g and 102.1 g, respectively.

Moreover, in Invention Examples 1-1, 1-2, 1-4, 1-6 and 1-7 in which the Al and Mg compositional ratio was satisfied and one or two types of In and Ga were included, it was seen that the amount of dross generated significantly decreased compared to Comparative Examples.

When a small amount of elements for preventing Mg oxidation were added in the hot-dip zinc alloy plating bath containing Mg and Al as described above, the generation of dross that was produced on the bath surface of the plating bath due to a Mg oxidation reaction may be reduced, and accordingly, plating workability may be improved in the plating process, and a high quality hot-dip zinc alloy plated steel sheet without surface defects due to dross may be produced.

Example 2

For physical property evaluations of the steel plate depending on the plating bath components, as a specimen for plating, a low carbon cold rolled steel plate having a thickness of 0.8 mm, a width of 100 mm and a length of 200 mm was prepared as a base steel plate, and then the base steel plate was immersed in acetone and ultrasonic cleaned in order to remove foreign substances such as rolling oil present on the surface.

The specimen for plating completed with foreign substance removal was heat treated under a reducing atmosphere at 750° C., and then was cooled to 470° C. before being led in the plating bath. Herein, the composition of the plating bath was prepared as shown in the following Table 2, and the temperature of the plating bath was maintained at 450° C. The cooled specimen was dipped for 3 seconds in each of the plating baths of Table 2, and then a plated steel sheet was prepared by adjusting the coating weight of the plating using $N_2$ gas wiping.

Thereafter, plated steel sheets having a single side coating weight of 60 g/m$^2$ were selected, and physical properties such as external surface, a dross reduction effect, corrosion resistance and the like of these plated steel sheets were evaluated, and the results are shown in the following Table 2 and FIG. 4.

Herein, the physical property evaluations were carried out by the following criteria.

1. external surface: 3-dimensional surface roughness was measured and dross or plating defects were observed with the naked eye.

○: surface roughness was less than 1 μm, and no dross or plating defects were generated.

Δ: surface roughness was 1 to 3 μm, a small quantity of dross or plating defects was generated.

x: surface roughness was greater than 3 μm, the plating layer was non-uniform, and a large quantity of plating defects was generated.

2. Dross reduction effect: the surface of the plating bath was left attended in the atmosphere for 1 hour, and then dross generated on the bath surface of the plating bath was observed with the naked eye.

○: there was almost no dross.

Δ: generation of dross was observed, however, the dross did not adhere to the plating layer.

x: plating was impossible due to the generation of dross or plating defects.

3. Corrosion resistance: an accelerated corrosion test was carried out using a salt spray test (salt spray standard test equivalent to KS-C-0223), and then the time passed until a rust-generated area on the plating layer surface reached 5% was measured.

○: a period of time greater than 500 hours had elapsed.

Δ: a period of time between 200 to 500 hours had elapsed.

x: a period of time less than 200 hours had elapsed.

TABLE 2

| Category | | Plating Bath Composition (% by weight) | | | | | Trace Element | External | Dross Reduction | Salt Spray |
|---|---|---|---|---|---|---|---|---|---|---|
| | | Al | Mg | In | Ga | Al + Mg | Segregation | Surface | Effect | Test |
| Invention Example | 2-1 | 2.5 | 3 | 0.1 | — | 5.5 | x | ○ | ○ | ○ |
| | 2-2 | 2.5 | 3.2 | 0.05 | — | 5.7 | x | ○ | ○ | ○ |
| | 2-3 | 2.5 | 3.2 | 0.1 | — | 5.7 | x | ○ | ○ | ○ |
| | 2-4 | 2 | 3.5 | 0.1 | — | 5.5 | x | ○ | ○ | ○ |
| | 2-5 | 3 | 4 | 0.1 | — | 7 | x | ○ | ○ | ○ |
| | 2-6 | 2.5 | 3 | — | 0.1 | 5.5 | x | ○ | ○ | ○ |
| | 2-7 | 2.5 | 3.2 | — | 0.05 | 5.7 | x | ○ | ○ | ○ |
| | 2-8 | 2.5 | 3.2 | — | 0.1 | 5.7 | x | ○ | ○ | ○ |
| | 2-9 | 2 | 3 | 0.05 | 0.05 | 5 | x | ○ | ○ | ○ |
| Comparative Example | 2-1 | 0.02 | 0 | — | — | 0.02 | x | ○ | ○ | x |
| | 2-2 | 0.8 | 1.2 | — | — | 2 | x | Δ | x | x |
| | 2-3 | 1.5 | 1.5 | — | — | 3 | x | Δ | ○ | x |
| | 2-4 | 2.5 | 3 | — | — | 5.5 | x | ○ | Δ | Δ |
| | 2-5 | 2.5 | 3.2 | 0.2 | — | 5.7 | x | ○ | ○ | Δ |
| | 2-6 | 2.5 | 3.2 | — | 0.15 | 5.7 | x | ○ | ○ | Δ |

TABLE 2-continued

| Category | Plating Bath Composition (% by weight) Al | Mg | In | Ga | Al + Mg | Trace Element Segregation | External Surface | Dross Reduction Effect | Salt Spray Test |
|---|---|---|---|---|---|---|---|---|---|
| 2-7 | 2 | 4 | — | — | 6 | x | Δ | x | ○ |
| 2-8 | 2 | 4 | 0.001 | — | 6 | x | Δ | x | ○ |
| 2-9 | 3 | 5 | — | — | 8 | x | x | x | ○ |
| 2-10 | 3 | 5 | 0.1 | — | 8 | x | x | Δ | ○ |
| 2-11 | 6 | 3 | 0.1 | — | 9 | x | Δ | Δ | ○ |
| 2-12 | 15 | 3 | — | — | 18 | x | Δ | Δ | Δ |
| 2-13 | 23 | 3 | — | — | 26 | x | Δ | Δ | Δ |

As shown in Table 2, when the content of the Mg and the Al among the composition of the plating layer did not satisfy the range of the present disclosure (Comparative Examples 2-1, 2-2 and 2-9 to 2-13), or when an In or Ga element was not additionally added even when the content of the Mg and the Al was satisfied (Comparative Examples 2-3, 2-4 and 2-7), it was seen that one or more physical properties had a disadvantage.

In comparison, in Invention Examples in which the content of the Mg and the Al was satisfied while containing a small amount of elements preventing the Mg oxidation, physical properties were satisfied in all cases.

Figure 4:
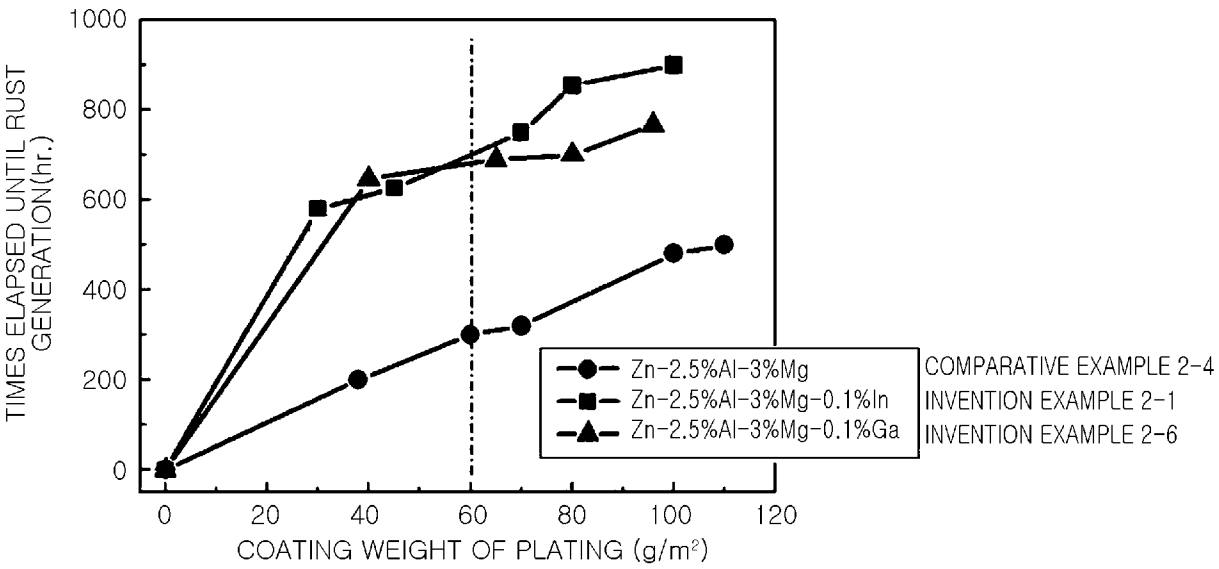
FIG. 4 illustrates results after carrying out a salt spray test on a plated steel sheet having undergone a plating process using hot-dip zinc alloy plating baths each having different constituents.

Particularly, as shown in FIG. 4, when the time taken to generate 5% of the rust area on the plating layer surface was measured based on the plated steel sheet having a single side coating weight of 60 g/m$^2$, the time taken was approximately 300 hours in Comparative Example 2-1 while the time taken was 700 hours and 680 hours in Invention Examples 2-1 and 2-6, respectively, which was an approximately two-fold increase.

Through the results shown above, when a plated steel sheet was prepared using a hot-dip zinc alloy plating bath in which In or Ga, an element for preventing Mg oxidation, was additionally added, an anti-corrosion property of the plating layer was enhanced, and surface defects of the steel plate were suppressed as well, and as a result, an elegant hot-dip zinc alloy plated steel sheet was able to be manufactured.

Example 3

After removing surface scale of the low carbon cold rolled steel plate having a thickness of 0.7 mm from a hot-melt plating facility continuously plating a steel tape using an acid pickling method, hot-dip zinc alloy plating was carried out under the condition described below, and then a plated steel sheet having a single side coating weight of 60 g/m$^2$ was prepared using $N_2$ gas wiping.

Herein, the cold rolled steel plate was heat treated under a reducing atmosphere at 750° C. before being prepared for plating, and the dew point inside the Snout was maintained at −40° C. during the plating process. In addition, the composition of the plating bath was prepared as shown in the following Table 3, and the temperature of the plating bath was maintained at 440° C. The cold rolled steel plate was dipping for 3 seconds in each of the plating baths of Table 3, and the steel plate was cooled at a rate of 10° C./s after the plating was complete.

In manufacturing the hot-dip zinc alloy plated steel sheet as described above, the amount of dross generated that was produced on the bath surface of the plating bath during the manufacturing process, and the dross component (Fe content) were analyzed and shown in the following Table 3, and in addition thereto, external surface and physical properties such as corrosion resistance of the hot-dip zinc alloy plated steel sheet were evaluated, and the results are also shown in the following Table 3.

Herein, the dross analysis and the physical property evaluations were carried out by the following criteria.

1. Dross weight: the cold rolled steel plate in which the surface scale was removed was continuously plated for 100 m, and then the weight of dross generated on the bath surface of the plating bath was measured.

2. Fe content inside dross: after a fixed amount of dross was collected from each plating bath after the plating was complete, the dross was processed to form a chip, then dissolved in a dilute hydrochloric acid solution, and the solution was analyzed using inductively coupled plasma (ICP) processing.

3. external surface: dross or plating defects were observed with the naked eye.

○: no dross or plating defects were generated.

Δ: a small quantity of dross or a small amount of plating defects was generated.

x: the plating layer was non-uniform, and a large quantity of plating defects was generated.

4. Corrosion resistance: an accelerated corrosion test was carried out using a salt spray test (salt spray standard test equivalent to KS-C-0223), and then the time passed until a rust-generated area on the plating layer surface reached 5% was measured.

○: a period of time greater than 500 hours had elapsed.

Δ: a period of time between 200 to 500 hours had elapsed.

x: a period of time less than 200 hours had elapsed.

TABLE 3

| Category | Plating Bath Composition (% by weight) Al | Mg | In | Ga | Al + Mg | Dross Weight (g) | Fe Content in Dross (% by weight) | External Surface | Salt Spray Test |
|---|---|---|---|---|---|---|---|---|---|
| Comparative Example 3-1 | 2.55 | 3.2 | 0 | 0 | 5.75 | 4.8 | 0.07 | Δ | ○ |

TABLE 3-continued

| Category | Plating Bath Composition (% by weight) Al | Mg | In | Ga | Al + Mg | Dross Weight (g) | Fe Content in Dross (% by weight) | External Surface | Salt Spray Test |
|---|---|---|---|---|---|---|---|---|---|
| Invention Example 3-1 | 2.56 | 3.22 | 0.005 | 0 | 5.78 | 4.7 | 0.03 | ○ | ○ |
| Invention Example 3-2 | 2.51 | 3.23 | 0.03 | 0 | 5.74 | 3.1 | 0.009 | ○ | ○ |
| Invention Example 3-3 | 2.54 | 3.21 | 0 | 0.01 | 5.75 | 4.2 | 0.02 | ○ | ○ |
| Invention Example 3-4 | 2.56 | 3.2 | 0 | 0.03 | 5.76 | 3.3 | 0.01 | ○ | ○ |

As shown in Table 3, it was identified that the amount of dross produced on the bath surface of the plating bath decreased as the amount of the In or Ga added to the hot-dip zinc alloy plating bath increased, and at the same time, it was identified that a hot-dip zinc alloy plated steel sheet having excellent corrosion resistance and an aesthetically pleasing surface may be obtained.

It is considered that the suppression of dross produced on the bath surface of the plating bath is due to the fact that Mg oxidation is prevented as described above, and the Fe content of the dross decreases by the addition of a small amount of Ga or In based on the fact that the Ga or In component of the plating layer suppresses the Fe yield of the steel plate.

While exemplary embodiments have been shown and described above, it will be apparent to those skilled in the art that modifications and variations could be made without departing from the scope of the present disclosure as defined by the appended claims.

The invention claimed is:

1. A hot-dip zinc alloy plated steel sheet having excellent corrosion resistance and an excellent external surface comprising:

a base steel plate; and a hot-dip zinc alloy plating layer, wherein a composition of the hot-dip zinc alloy plating layer includes, in % by weight, aluminum (Al): 0.5 to 5.0%, magnesium (Mg): 1 to 5%, and (a) indium (In): 0.005 to 0.1% or (b) gallium (Ga): 0.01 to 0.1% and indium (In): 0.005 to 0.1%, a remainder of zinc (Zn) and unavoidable impurities, and a compositional ratio of the Mg and the Al satisfies the relationships of [Al+Mg≤7] and [Mg>Al], wherein the hot-dip zinc alloy plating layer employs a Zn—Al—$MgZn_2$ ternary eutectic structure as a base structure, wherein the hot-dip zinc alloy plating layer includes a plating structure in which a Zn—$MgZn_2$ binary eutectic structure is dispersed, wherein the hot-dip zinc alloy plating layer includes an Al single phase structure and a Zn single phase structure in an amount of 20% or less, and wherein the hot-dip zinc alloy plating layer includes a $MgZn_2$ structure as a remainder.

2. The hot-dip zinc alloy plated steel sheet having excellent corrosion resistance and an excellent external surface of claim 1, wherein the hot-dip zinc alloy plating layer is attached in a plating amount of 10 to 500 g/$m^2$ based on one surface.

3. The hot-dip zinc alloy plated steel sheet having excellent corrosion resistance and an excellent external surface of claim 1, which has surface roughness (Ra) of 1 μm or less.

4. A method for manufacturing a hot-dip zinc alloy plated steel sheet according to claim 1 having excellent corrosion resistance and an excellent external surface comprising:

preparing a hot-dip zinc alloy plating bath including, in % by weight, aluminum (Al): 0.5 to 5.0%; magnesium (Mg): 1 to 5%; and (a) indium (In): 0.005 to 0.1% or (b) gallium (Ga): 0.01 to 0.1% and indium (In): 0.005 to 0.1%; and a remainder of zinc (Zn) and unavoidable impurities, and a compositional ratio of the Mg and the Al satisfies a relationship of [Al+Mg<7];

preparing a plated steel sheet by dipping a base steel plate in the hot-dip zinc alloy plating bath and carrying out plating; and gas wiping and cooling the plated steel sheet.

5. The method for manufacturing a hot-dip zinc alloy plated steel sheet having excellent corrosion resistance and an excellent external surface of claim 4, wherein the hot-dip zinc alloy plating bath plating carries out the plating at a temperature of greater than or equal to melting point to less than or equal to 440° C.

6. The method for manufacturing a hot-dip zinc alloy plated steel sheet having excellent corrosion resistance and an excellent external surface of claim 4, wherein the gas used in the gas wiping is nitrogen ($N_2$).

7. The method for manufacturing a hot-dip zinc alloy plated steel sheet having excellent corrosion resistance and an excellent external surface of claim 4, wherein the cooling is carried out at a cooling rate of 10° C./s or more.

* * * * *